US010059560B2

(12) United States Patent
Schaffer et al.

(10) Patent No.: US 10,059,560 B2
(45) Date of Patent: Aug. 28, 2018

(54) WINDING DEVICE FOR STRAND-LIKE MATERIAL TO BE WOUND

(71) Applicant: MASCHINENFABRIK NIEHOFF GMBH & CO. KG, Schwabach (DE)

(72) Inventors: Michael Schaffer, Spalt (DE); Rudolf Bader, Marktoberdorf (DE); Bernhard Enzensberger, Wald (DE); Andreas Kraus, Schwabach (DE); Timo Borchert, Marktoberdorf (DE); Hubert Reinisch, Freiberg am Neckar (DE)

(73) Assignee: MASCHINENFABRIK NIEHOFF GMBH & CO. KG, Schwabach (DE)

( * ) Notice: Subject to any disclaimer, the term of this patent is extended or adjusted under 35 U.S.C. 154(b) by 0 days.

(21) Appl. No.: 15/312,396

(22) PCT Filed: May 19, 2015

(86) PCT No.: PCT/EP2015/060960
§ 371 (c)(1),
(2) Date: Nov. 18, 2016

(87) PCT Pub. No.: WO2015/177121
PCT Pub. Date: Nov. 26, 2015

(65) Prior Publication Data

US 2017/0088389 A1 Mar. 30, 2017

(30) Foreign Application Priority Data

May 22, 2014 (DE) ..... 10 2014 007 552

(51) Int. Cl.
*B65H 54/28* (2006.01)

(52) U.S. Cl.
CPC ..... *B65H 54/2872* (2013.01); *B65H 54/2812* (2013.01); *B65H 54/2851* (2013.01); *B65H 2701/36* (2013.01)

(58) Field of Classification Search
CPC ..... B65H 54/04; B65H 54/2812; B65H 54/2851; B65H 54/2854; B65H 54/2872; B65H 2701/36
See application file for complete search history.

(56) References Cited

U.S. PATENT DOCUMENTS 3,951,355 A 4/1976 Morioka et al.
4,421,284 A 12/1983 Pan

FOREIGN PATENT DOCUMENTS

DE 33 08 283 A1 9/1984
GB 1 328 542 A 8/1973
(Continued)

OTHER PUBLICATIONS

Machine Translation of DE 3308283 A1, Sep. 20, 1984. (Year: 1984).*
(Continued)

*Primary Examiner* — William E Dondero
(74) *Attorney, Agent, or Firm* — Sheridan Ross P.C.

(57) ABSTRACT

The invention relates to a winding device for winding strand-like material to be wound onto a rotating reel (2), which winding device has a laying apparatus (9) by means of which the material to be wound is guided to the run-on point on the winding. The laying apparatus (9) is substantially movable in the direction of the axis of rotation (3) of the reel (2). Furthermore the winding device (1) has at least one sensor for determining the run-on angle of the material to be wound onto the winding. The winding device (1) is designed in such a way that the movement of the laying apparatus (9) during the winding process is regulated as a function of the run-on angle determined by means of the at least one sensor. According to the invention the distance between the run-off point at which the material to be wound leaves the laying apparatus (9) and the run-on point during the winding process at least at times is at most four times,
(Continued)

Figure 1:
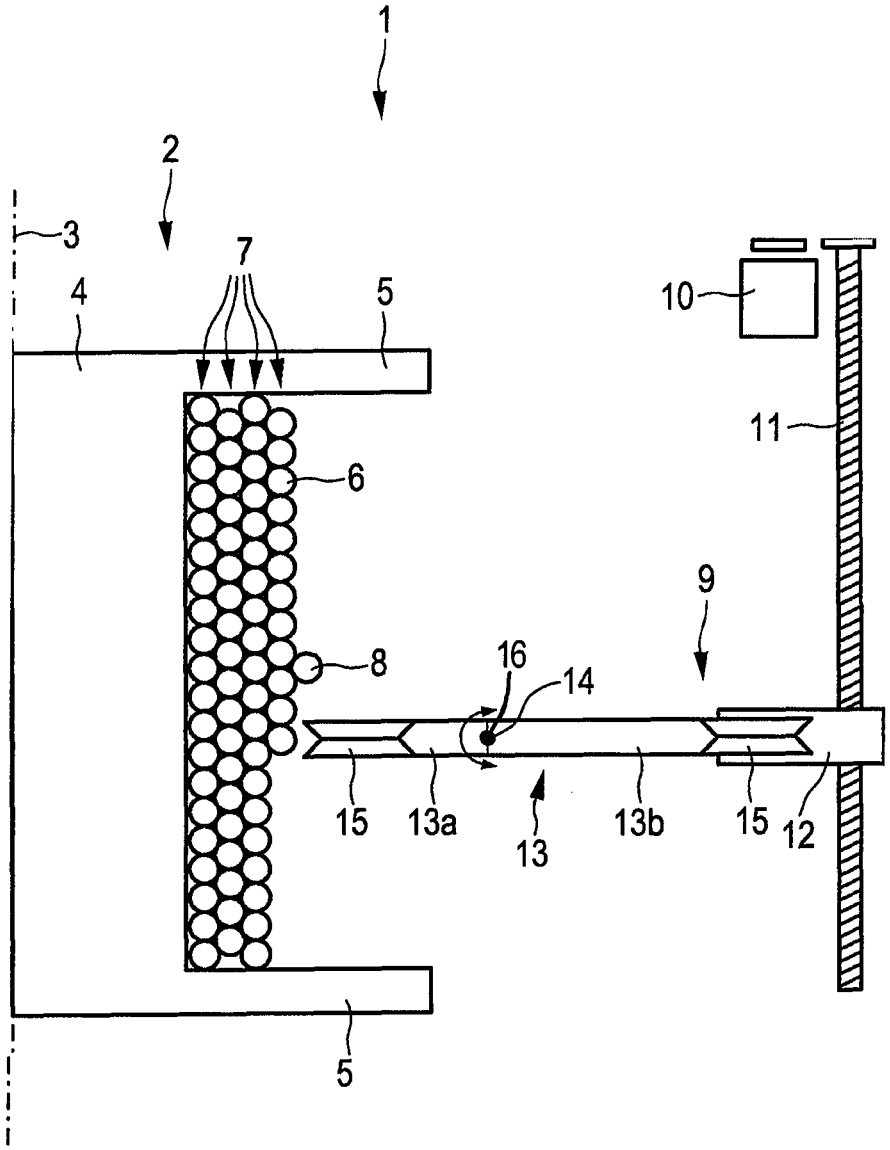

preferably at most twice, more preferably at most equal to the diameter of the material to be wound. Due to this small distance, a good winding of the reel is achieved, in which the individual turns rest against one another. In particular the "crossing over" of individual turns is avoided and the material to be wound is treated carefully.

11 Claims, 2 Drawing Sheets

(56) References Cited

FOREIGN PATENT DOCUMENTS

| | | | |
|---|---|---|---|
| JP | 01220680 A | * | 9/1989 |
| JP | H01 220680 A | | 9/1989 |

OTHER PUBLICATIONS

Machine Translation of JP 01-220680 A, Sep. 4, 1989. (Year: 1989).*

Translation of the International Preliminary Report on Patentability for International (PCT) Patent Application No. PCT/EP2015/060960, dated Dec. 1, 2016, 8 pages.

International Search Report prepared by the European Patent Office dated Jul. 27, 2015, for International Application No. PCT/EP2015/060960.

* cited by examiner

WINDING DEVICE FOR STRAND-LIKE MATERIAL TO BE WOUND

CROSS REFERENCE TO RELATED APPLICATIONS

This application is a national stage application under 35 U.S.C. 371 and claims the benefit of PCT Application No. PCT/EP2015/060960 having an international filing date of 19 May 2015, which designated the United States, which PCT application claims the benefit of German Patent Application No. DE 10 2014 007 552.4 filed 22 May 2014, the disclosures of each of which are incorporated herein by reference in their entireties.

The invention relates to a winding device for winding strand-like coilable material onto a rotating spool.

The strand-like coilable material can for example be a metallic or non-metallic, coated or uncoated wire, a single or multicore cable, a strand, a fiber, for example a natural or synthetic fiber, particularly a fiber for special technical applications such as a fiber optic cable, a filament, cord or rope.

A spool is to be understood as a preferably rotationally symmetric body preferably having a cylindrical, conical or even bi-conical spool body. The spool can further comprise at least one preferably disk-shaped flange disposed on an end of the spool body, its diameter generally being significantly larger than the largest diameter of the spool body.

A winding device of the type at issue further comprises a traverse mechanism by means of which the coilable material is guided to the run-on point on the spooling. The run-on point is thereby to be understood as that point at which the coilable material enters the spooling on the spool during the winding process, thus at which the coilable material, seen from its direction of travel, first makes contact with the spooling already formed. The location of the run-on point thus changes relative to the non-moving parts of the winding device and to the surroundings during the winding process.

The traverse mechanism is substantially movable in the direction of the spool's rotational axis.

By the spool rotating about its rotational axis and the coilable material being simultaneously fed via the traverse mechanism, individual coilings of the coilable material are formed on the spool. By the traverse mechanism additionally moving in the direction of the spool's rotational axis, the coilings end up lying alongside each other on the spool and thus form a continuous layer of coilings.

Different types of coiling geometries are known, for example helical and orthocyclic coilings.

By appropriately changing the direction of movement of the traverse mechanism at a respective end point of the spooling, for example—if provided—at the respective flange of the spool, the forming of one layer ends and another layer starts forming atop the previously formed layer.

In order to form a uniform spooling consisting of a plurality of layers of closely adjacent coilings, it must be ensured that no "breaks," i.e. gaps, form between the coilings and also that no coiling "piles up" onto the coiling formed immediately beforehand, "skipping over" it, which would result in the spooling having an irregular diameter. This requires good control of the traverse mechanism's displacement speed in the direction of the rotational axis subject to the rotational speed of the spool and to the properties of the coilable material such as its diameter, surface structure and the frictional coefficients of its surface or its rigidity.

Regulating the movement of the traverse mechanism during the winding process as a function of the run-on angle of the coilable material has proven advantageous. The run-on angle is thereby the angle between a perpendicular on the spool's rotational axis and the run-on axis of the coilable material, whereby the run-on axis refers to the axis along which the coilable material enters onto the spooling.

If, for example, the run-on angle is open toward the traverse mechanism's direction of movement as seen from the perpendicular on the spool's rotational axis; i.e. in the direction in which the winding forms on the spool, and its magnitude exceeds a specific value, this can mean that the traverse mechanism is situated too far backward as seen from the direction of movement, whereupon the control would slightly increase the displacement speed. If, on the other hand, the run-on angle is open counter to the direction of movement and exceeds its magnitude by a specific value, the control would then slightly decrease the displacement speed accordingly.

The winding device thereby comprises at least one sensor for determining the run-on angle of the coilable material.

Such a regulation of the displacement of the traverse mechanism as a function of the run-on angle is used for example in DE 195 08 051 A1 and DE 38 27 078 A1.

The task on which the present invention is based is that of further improving a winding device of the described type for the spooling of strand-like coilable material onto a rotating spool.

This task is solved by a winding device in accordance with claim 1. Further advantageous embodiments of the invention are set forth in the dependent claims.

In the inventive winding device, the distance between the run-off point and the run-on point during the winding process amounts, at least intermittently, to no more than quadruple, preferably no more than double, further preferably is at most equal to the diameter of the coilable material. To be understood as the run-off point here is that point at which the coilable material leaves the traverse mechanism, i.e. where the coilable material is last in contact with the traverse mechanism when seen from its direction of travel.

Preferentially, the distance between the run-off point and the run-on point during the winding process even always amounts to no more than quadruple, preferably no more than double, further preferably is at most equal to the diameter of the coilable material.

This short distance between the run-off point and run-on point at which the coilable material is not guided, thus travels "freely" in the space, enables a reliable and precise guiding of the coilable material, and thus the achieving of a good winding of the spool with closely adjacent individual coilings. In particular, this prevents individual coilings from "skipping over" and gently protects the coilable material, for example by preventing pressure points and damage, whereby this results in increasing the quality of the spool's winding. Further advantages include a high fill capacity of the spool due to the uniform spooling, high spooling reproducibility and the feasibility of automated operation without operator input.

In one preferential embodiment of the invention, the traverse mechanism comprises a traverse lance along which the coilable material is guided to the run-on point on the spool. The traverse lance is preferably elongated, further preferably rod-shaped, and preferably always longitudinally extends at least proximately along the run-on axis. The traverse lance can, however, exhibit a different form, for example a disk-shaped form.

In a no-load position, for example in which the coilable material is not being subjected to any mechanical stress, the traverse lance and the run-on axis are preferably orientated at a right angle to the rotational axis of the spool, i.e. a run-on angle measured at this position is zero.

The traverse lance allows the coilable material to be advanced very close to the run-on point on the spooling and thus being able to achieve the short distance according to the invention.

Particularly preferential is for the traverse lance to be displaceably affixed to the traverse mechanism such that the distance from the run-off point to the rotational axis of the spool can be changed during the winding process. By appropriately adjusting this distance, the distance between the run-off point and the run-on point can be kept substantially constant as the diameter of the spooling on the spool increases during the winding process.

In a further preferential embodiment of the invention, the traverse lance is in itself movable in a plane which comprises the run-on axis and which is parallel to the rotational axis of the spool. Movement of the traverse lance in this plane can thus effect a change of the run-on axis and hence the run-on angle.

Preferentially, the movability of the traverse lance in itself is achieved by the traverse lance being of flexible construction. As the movability of the traverse lance is thus already a function of its material properties, no further structural element is then necessary.

Particularly preferentially, the movability of the traverse lance it itself is however achieved by the traverse lance being of multi-part configuration, wherein at least two of its parts are movably connected together, particularly by a joint or a hinge. This thereby achieves the movability of the traverse lance in itself not being opposed by any or only very slight restoring torque such that the tension of the coilable material is not or is only minimally affected by the traverse lance's movement in itself.

Preferentially, the at least one sensor is affixed to the traverse lance. Doing so also enables the run-on angle to be measured at very close distance to the run-on point and thus with a high degree of accuracy. In a multi-part traverse lance, it is particularly preferential for the at least one sensor to be affixed at or close to the point of the traverse lance at which the two parts of said traverse lance can move against each other.

Particularly preferentially, the at least one sensor is configured to measure the traverse lance's movement it itself. If at least a part of the traverse lance always extends substantially along the run-on axis, the run-on angle can also be determined from the sensor's measurement.

Particularly preferentially, the traverse lance comprises at least one deflection roller over which the coilable material is guided.

Particularly preferentially, the at least one sensor is an optical or mechanical sensor or a combination of the two, for example a laser sensor having a mechanical angle sensor which preferably utilizes a triangulation-like process to measure angles.

In a further preferential embodiment of the invention, the spool comprises at least one flange. Furthermore, the winding device is designed such that the distance from the run-off point to the rotational axis of the spool during the winding process is, at least intermittently, shorter than the diameter of the flange. In other words, the traverse mechanism, in particular the traverse lance, can thus "plunge" into the spool alongside the flange or in between the flanges. This thereby enables the desired short distance between the run-off point and the run-on point to be also achieved in the case of a spool with flanges.

The invention further relates to a method for winding strand-like coilable material onto a rotating spool using a winding device according to the invention.

In the winding method according to the invention, the distance between the run-off point and the run-on point amounts, at least intermittently, to no more than quadruple, preferably no more than double, further preferably is at most equal to the diameter of the coilable material during the winding process.

The inventive winding method can also comprise the step of calculating the traverse pitch from the diameter of the spool body and the diameter of the product.

Figure 2:
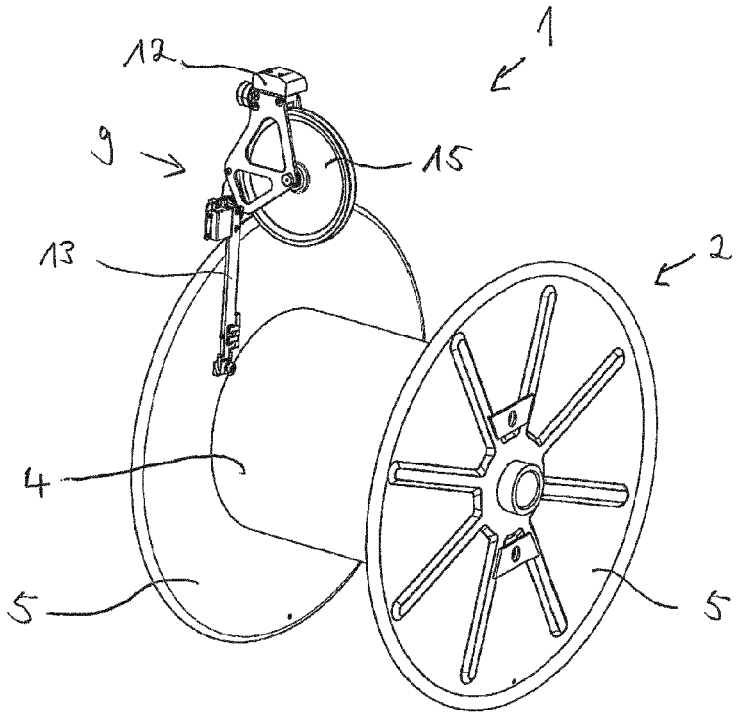
Figure 3:
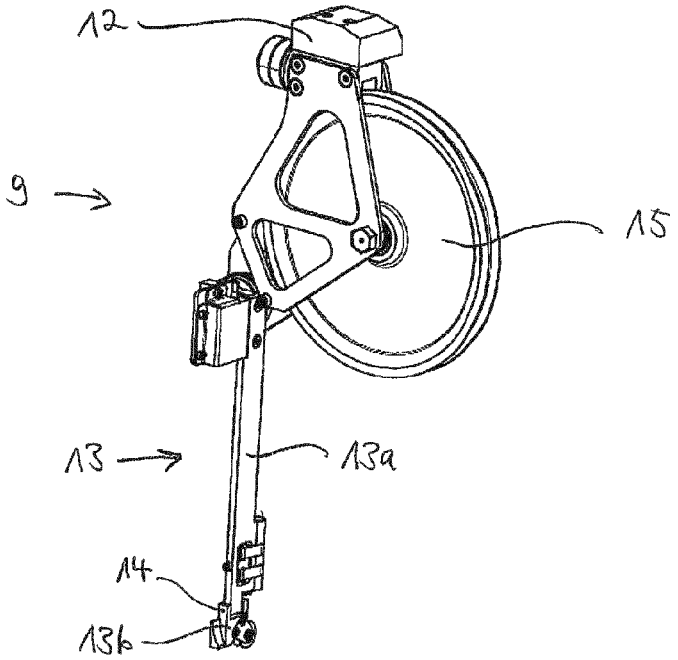

Further developments and advantages of the invention are set forth below in conjunction with the accompanying, partly schematic figures. Shown are:

FIG. 1 a cross section through an inventive winding device with a partially wound spool;

FIG. 2 a perspective diagonal view of part of an inventive winding device with an empty spool;

FIG. 3 a magnified detail representation of the traverse mechanism of the FIG. 2 winding device.

FIG. 1 shows a schematic cross section of an inventive winding device 1 with a partially wound spool 2 which is pivotably mounted about a rotational axis 3. The spool 2 comprises a spool body 4 having flanges 5 attached at both its ends.

The winding device 1 has already partially formed a spooling of coilable material having a round cross section between the flanges 5 of the spool 2. The coilable material is preferably wire and preferably has a diameter between 8 and 30 mm.

The spooling consists of a plurality of layers 7 of individual coilings 6 which form a hexagonal arrangement in cross section (depicted in an idealized form in FIG. 1).

Coiling 8 represents an example of an "overskip coiling" which skipped over the previously formed coiling when the outermost layer 7 was being wound and came to rest further radially outward at that point. After coiling 8, three further coilings then formed properly in the last wound layer 7. Such overskip coilings 8 are to be prevented wherever possible during spooling since the distortions they cause to a uniform spool winding are further intensified in subsequent layers, which can result in an overall irregular poor spooling of the spool with a correspondingly poor degree of spool filling.

The winding device 1 comprises a traverse mechanism 9 which is displaceable along a spindle 11 arranged parallel to the rotational axis 3 of the spool 2. To that end, the spindle 11 is rotated by a motor 10, whereby a traverse carriage 12 displaceably mounted on the external-thread spindle 11 and having a corresponding internal thread (not shown) is set into linear motion along the spindle 11.

The traverse carriage 12 is connected to a traverse lance 13 aligned perpendicular to the rotational axis 3 and to the spindle 11. The traverse lance 13 consists of a rear part **13*b* rigidly connected to the traverse carriage 12 and a front part 13*a* rotatably mounted to the rear part 13*b* by means of a swivel joint 14, wherein rotation is possible in that plane which extends through the traverse lance 13 and the rotational axis 3, i.e. the projection plane in FIG. 1 (indicated by the semicircular double arrow on joint 14**).

The coilable material is fed along the traverse lance 13 to the spooling via two deflection rollers 15 (in the interest of clarity, the coilable material itself is not depicted in FIG. 1).

One notes that the distance between the outermost position of the left deflection roller 15 and the last wound coiling, i.e. the distance between the run-off point and the run-on point is less than one time the diameter of the coilable material. A (not shown) mechanism can be employed to adjust this distance, for example by the traverse lance 13 being pivotable about the spindle 11 by a predefined angle.

The traverse lance 13 thus plunges between the two flanges 5 of the spool 2 during the winding process, but can however also be pivoted into the region between the flanges 5 at the beginning of the winding process or pivoted back out of same again at the end of the winding process respectively. Thus, changing spools without the spool 2 being able to collide with the traverse lance 13 presents no difficulty.

The angle between the front part 13*a* and the rear part 13*b* of the traverse lance 13 can be measured by a sensor 16 affixed to the joint 14 on the traverse lance 13. As the rear part 13*b* is always perpendicular to the rotational axis 3 and the front part 13*a* extends in the direction of the run-on axis of the coilable material, said angle corresponds to the run-on angle of the coilable material.

By appropriately regulating the traversing speed, i.e. the displacement speed of the traverse carriage 12 along the spindle 11, which results from the rotational speed of the spindle 11, as a function of the measured run-on angle, the traversing can be controlled such that the coilings lie against each other without any gaps forming or the coilings skipping as described above.

The desired line speed, i.e. the feed rate of the coilable material, and the traversing speed resulting therefrom at a specific point in time, is preferably provided to the control as the target value.

The traversing speed is preferably regulated in real-time, i.e. the sensor data is processed so rapidly that the control procedure has no impact on the traversing speed.

The control procedure is hereby designed such that there is no attempt to direct the coilable material into exact trajectories. Instead, only the traverse mechanism 9 is adjusted on the basis of the measured run-on angle such that the traverse lance 13 is always in the best possible position for spooling. Only the winding of the coiling being wound at that present moment is readjusted, not however previously wound coilings or layers.

The first, i.e. innermost layer can be formed on an unwound spool without any control, only by a controlled displacing of the traverse mechanism 9.

Furthermore, one or more suitable, preferably optical sensors (not shown) can detect the flanges 5 of the spool 2 so that the traversing direction, i.e. the direction of displacement of the traverse mechanism 9 along the rotational axis 3, automatically reverses upon reaching a flange 5 in order to form the next layer in the reverse direction. This change in direction can however also occur at fixed predefined switching points which correspond to the positions of the flanges 5 along the path of movement of the traverse mechanism 9.

The sensor data can be captured in digital or analog form. Furthermore, open interfaces to external controllers can be provided in the winding device 1 in order to enable a flexible and modular design of the winding device 1.

FIG. 2 shows a perspective diagonal view of part of the inventive winding device 1 with an empty spool only depicted schematically in FIG. 1. FIG. 3 shows a magnified detail representation of the traverse mechanism 9 from FIG. 2. The reference numerals thereby correspond to those of FIG. 1.

LIST OF REFERENCE NUMERALS

1 winding device
2 spool
3 rotational axis
4 spool body
5 flange
6 coiling
7 layer
8 overskip coiling
9 traverse mechanism
10 motor
11 spindle
12 traverse carriage
13 traverse lance
13*a* front part of traverse lance
13*b* rear part of traverse lance
14 joint
15 deflection roller

The invention claimed is:

1. A winding device for winding strand-like coilable material onto a rotating spool, comprising a traverse mechanism by means of which the coilable material is guided to a run-on point at which the coilable material enters a spooling on the spool and which is substantially movable in a direction of a rotational axis of the spool, further comprising at least one sensor for determining a run-on angle of the coilable material between a perpendicular on the rotational axis of the spool and a run-on axis along which the coilable material enters onto the spooling on the spool, wherein the winding device is designed such that a displacement of the traverse mechanism during a winding process is regulated as a function of the run-on angle determined by the at least one sensor, wherein a distance between a run-off point, at which the coilable material leaves the traverse mechanism, and the run-on point amounts, at least intermittently, to no more than quadruple a diameter of the coilable material during the winding process, wherein the traverse mechanism comprises a traverse lance along which the coilable material is guided to the run-on point on the spooling, wherein the traverse lance is in itself movable in a plane which comprises the run-on axis and which is parallel to the rotational axis of the spool, and wherein the traverse lance is of multi-part configuration and at least two of its parts are movably connected together.

2. The winding device according to claim 1, wherein the traverse lance is displaceably affixed to the traverse mechanism such that a distance from the run-off point to the rotational axis of the spool can be changed during the winding process.

3. The winding device according to claim 1, wherein the traverse lance is flexible.

4. The winding device according to claim 1, wherein the at least one sensor is affixed to the traverse lance.

5. The winding device according to claim 1, wherein the at least one sensor is configured to measure movements of the traverse lance in itself.

6. The winding device according to claim 1, wherein the traverse lance comprises at least one deflection roller over which the coilable material is guided.

7. The winding device according to claim 1, wherein the at least one sensor is an optical or mechanical sensor or a combination of the two.

8. The winding device according to claim 1, wherein the spool comprises at least one flange and that the winding device is designed such that a distance from the run-off point to the rotational axis of the spool during the winding process is, at least intermittently, shorter than a diameter of the flange.

9. The winding device according to claim 1, wherein the distance between the run-off point, at which the coilable material leaves the traverse mechanism, and the run-on point amounts, at least intermittently, to no more than double the diameter of the coilable material during the winding process.

10. The winding device according to claim 1, wherein the distance between the run-off point, at which the coilable material leaves the traverse mechanism, and the run-on point amounts, at least intermittently, to at most equal to the diameter of the coilable material during the winding process.

11. A method for winding strand-like coilable material onto a rotating spool by means of the winding device in accordance with claim 1, the method comprising:

rotating the spool about its rotational axis;

simultaneously feeding the coilable material via the traverse mechanism;

guiding the coilable material to the run-on point on the spooling;

moving the traverse mechanism in the direction of the spool's rotational axis; and changing the direction of movement of the traverse mechanism at a respective end point of the spooling.

* * * * *